US010995394B2

(12) United States Patent
Matsuo et al.

(10) Patent No.: US 10,995,394 B2
(45) Date of Patent: May 4, 2021

(54) STEEL BAR FOR DOWNHOLE MEMBER, AND DOWNHOLE MEMBER

(71) Applicant: NIPPON STEEL & SUMITOMO METAL CORPORATION, Tokyo (JP)

(72) Inventors: Daisuke Matsuo, Tokyo (JP); Takuji Nakahata, Tokyo (JP); Hisashi Amaya, Tokyo (JP); Tsutomu Okuyama, Tokyo (JP); Hideki Takabe, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 81 days.

(21) Appl. No.: 16/099,330

(22) PCT Filed: May 19, 2017

(86) PCT No.: PCT/JP2017/018804
§ 371 (c)(1),
(2) Date: Nov. 6, 2018

(87) PCT Pub. No.: WO2017/200083
PCT Pub. Date: Nov. 23, 2017

(65) Prior Publication Data

US 2019/0177823 A1 Jun. 13, 2019

(30) Foreign Application Priority Data

May 20, 2016 (JP) ..... JP2016-101932

(51) Int. Cl.
*C22C 38/50* (2006.01)
*C22C 38/54* (2006.01)
(Continued)

(52) U.S. Cl.
CPC ..... *C22C 38/50* (2013.01); *C22C 38/00* (2013.01); *C22C 38/001* (2013.01);
(Continued)

(58) Field of Classification Search
CPC ..... C21D 2211/008; C21D 9/08; C21D 9/18; C22C 38/00; C22C 38/44
(Continued)

(56) References Cited

U.S. PATENT DOCUMENTS

2009/0162239 A1* 6/2009 Takabe ..... C22C 38/42 420/58
2015/0044086 A1 2/2015 Miyanishi et al.

FOREIGN PATENT DOCUMENTS

EP 2060644 A1 5/2009
JP 11080881 A 3/1999
(Continued)

OTHER PUBLICATIONS

NPL: on-line translation of JP 11-80881 A, Mar. 1999 (Year: 1999).*
(Continued)

*Primary Examiner* — Jie Yang
(74) *Attorney, Agent, or Firm* — Greer, Burns & Crain, Ltd.

(57) ABSTRACT

A steel bar for a downhole member is provided that is excellent in SCC resistance and SSC resistance. A martensitic stainless steel bar material for a downhole member of the present embodiment has a chemical composition that contains, by mass %, C: 0.020% or less, Si: 1.0% or less, Mn: 1.0% or less, P: 0.03% or less, S: 0.01% or less, Cu: 0.10 to 2.50%, Cr: 10 to 14%, Ni: 1.5 to 7.0%, Mo: 0.2 to 3.0%, Ti: 0.05 to 0.3%, V: 0.01 to 0.10%, Nb: 0.1% or less, Al: 0.001 to 0.1% and N: 0.05% or less, with the balance being Fe and impurities, and satisfies Formula (1) and Formula (2).

$$[Mo]-4\times[\text{total Mo amount in precipitate at R/2 position}]\geq 1.30 \quad (1)$$

(Continued)

[Total Mo amount in precipitate at center position]−[total Mo amount in precipitate at R/2 position] ≤0.03 (2)

4 Claims, 2 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/52*** | (2006.01) |
| *C21D 9/08* | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/52* (2013.01); *C22C 38/54* (2013.01); *C21D 9/08* (2013.01); *C21D 2211/008* (2013.01)

(58) Field of Classification Search
USPC ..... 148/325
See application file for complete search history.

(56) References Cited

FOREIGN PATENT DOCUMENTS

| | | | |
|---|---|---|---|
| JP | 2001107141 | A | 4/2001 |
| JP | 3743226 | B2 | 2/2006 |
| JP | 2010242163 | A | 10/2010 |
| JP | 2011089159 | A | 5/2011 |

OTHER PUBLICATIONS

Int'l. Search Report issued in Int'l. Application No. PCT/JP2017/018804, dated Aug. 8, 2017.
European search report of EP 17 79 9507.3, dated Sep. 26, 2019.

* cited by examiner

STEEL BAR FOR DOWNHOLE MEMBER, AND DOWNHOLE MEMBER

This is a National Phase Application filed under 35 U.S.C. § 371, of International Application No. PCT/JP2017/018804, filed May 19, 2017, the contents of which are incorporated by reference.

TECHNICAL FIELD

The present invention relates to a steel bar and a downhole member, and more particularly relates to a steel bar for a downhole member for use in a downhole member that is to be used together with oil country tubular goods in oil wells and gas wells, and to a downhole member.

BACKGROUND ART

In order to extract production fluids such as oil or natural gas from oil wells and gas wells (hereinafter oil wells and gas wells are collectively referred to as "oil wells"), oil country tubular goods and downhole members are used in the aforementioned oil well environment.

FIG. 1 is a view illustrating an example of oil country tubular goods and downhole members that are used in an oil well environment. Oil country tubular goods are, for example, casing, tubing and the like. In FIG. 1, two strings of tubing 2 are arranged in a casing 1. The front end of each tubing 2 is fixed inside the casing 1 by a packer 3, a ball catcher 4, a blast joint 5 and the like. The downhole members are, for example, the packer 3, the ball catcher 4 and the blast joint 5, and are utilized as accessories of the casing 1 and the tubing 2.

Unlike the case of the oil country tubular goods, many downhole members do not have a symmetrical shape (point-symmetrical shape) with respect to the pipe axis (central axis of pipe). Therefore, a round bar (steel bar for a downhole member), which is solid, is usually adopted as a starting material for a downhole member. A downhole member having a predetermined shape is produced by subjecting such a round bar to cutting or piercing to remover a part of the bar. Although the size of a steel bar for a downhole member will depend on the size of the downhole member, for example, the diameter of a steel bar for a downhole member is from 152.4 to 215.9 mm, and the length of a steel bar for a downhole member is, for example, 3,000 to 6,000 mm.

As described above, downhole members are used in oil well environments, similarly to oil country tubular goods. Production fluids contain corrosive gases such as hydrogen sulfide gas and carbon dioxide gas. Therefore, similarly to oil country tubular goods, downhole members are also required to have excellent stress corrosion cracking resistance (hereunder, referred to as "SCC resistance"; SCC: Stress Corrosion Cracking) and excellent sulfide stress cracking resistance (hereunder, referred to as "SSC resistance"; SSC: Sulfide Stress Cracking).

If martensitic stainless steel containing around 13% of Cr (hereunder, referred to as "13Cr steel") is utilized for oil country tubular goods, excellent SCC resistance and SSC resistance are obtained. However, in the case of utilizing 13Cr steel for a downhole member, the SCC resistance and SSC resistance sometimes decrease in comparison to the case of oil country tubular goods.

Accordingly, an Ni-based alloy as typified by Alloy 718 (trade mark) is normally used as a round bar for a downhole member. However, when a downhole member is produced using an Ni-based alloy, the production cost increases. Therefore, studies are being conducted with respect to production of downhole members using stainless steel which costs less than an Ni-based alloy.

Japanese Patent No. 3743226 (Patent Literature 1) proposes a martensitic stainless steel for a downhole member that is excellent in sulfide stress corrosion cracking resistance. The martensitic stainless steel disclosed in Patent Literature 1 consists of, by mass %, C: 0.02% or less, Si: 1.0% or less, Mn: 1.0% or less, P: 0.03% or less, S: 0.01% or less, Cr: 10 to 14%, Mo: 0.2 to 3.0%, Ni: 1.5 to 7%, N: 0.02% or less, with the balance being Fe and unavoidable impurities, in which forging and/or billeting are performed so as to satisfy the formula: 4 Sb/Sa+12 Mo≥25 (Sb: sectional area before forging and/or billeting; Sa: sectional area after forging and/or billeting; Mo: mass % value of contained Mo) according to the Mo amount.

CITATION LIST

Patent Literature

Patent Literature 1: Japanese Patent No. 3743226

SUMMARY OF INVENTION

Technical Problem

SSC resistance of a certain level can be obtained even with the martensitic stainless steel for a downhole member proposed in Patent Literature 1. However, a steel bar for a downhole member is also desired that provides good SCC resistance and SSC resistance using a different composition to Patent Literature 1.

An objective of the present invention is to provide a steel bar for a downhole member that is excellent in SCC resistance and SSC resistance.

Solution to Problem

A steel bar for a downhole member according to the present embodiment has a chemical composition consisting of, by mass %, C: 0.020% or less, Si: 1.0% or less, Mn: 1.0% or less, P: 0.03% or less, S: 0.01% or less, Cu: 0.10 to 2.50%, Cr: 10 to 14%, Ni: 1.5 to 7.0%, Mo: 0.2 to 3.0%, Ti: 0.05 to 0.3%, V: 0.01 to 0.10%, Nb: 0.1% or less, Al: 0.001 to 0.1%, N: 0.05% or less, B: 0 to 0.005%, Ca: 0 to 0.008%, and Co: 0 to 0.5%, with the balance being Fe and impurities. When an Mo content of the aforementioned chemical composition of a steel bar for a downhole member is defined as [Mo amount] (mass %), and an Mo content in precipitate at a position that bisects a radius from the surface of the steel bar for a downhole member to the center of the steel bar for a downhole member in a cross-section perpendicular to a lengthwise direction of the steel bar for a downhole member is defined as [total Mo amount in precipitate at R/2 position] (mass %), the steel bar for a downhole member satisfies Formula (1). In addition, when an Mo content in precipitate at a center position of a cross-section perpendicular to a lengthwise direction of the steel bar for a downhole member is defined as [total Mo amount in precipitate at center position] (mass %), the steel bar for a downhole member satisfies Formula (2).

$$[\text{Mo amount}]-4\times[\text{total Mo amount in precipitate at R/2 position}]\geq 1.30 \quad (1)$$

[Total Mo amount in precipitate at center position]−[total Mo amount in precipitate at R/2 position] ≤0.03 (2)

Advantageous Effects of Invention

A steel bar for a downhole member according to the present embodiment is excellent in SCC resistance and SSC resistance.

DESCRIPTION OF EMBODIMENTS

Figure 1:
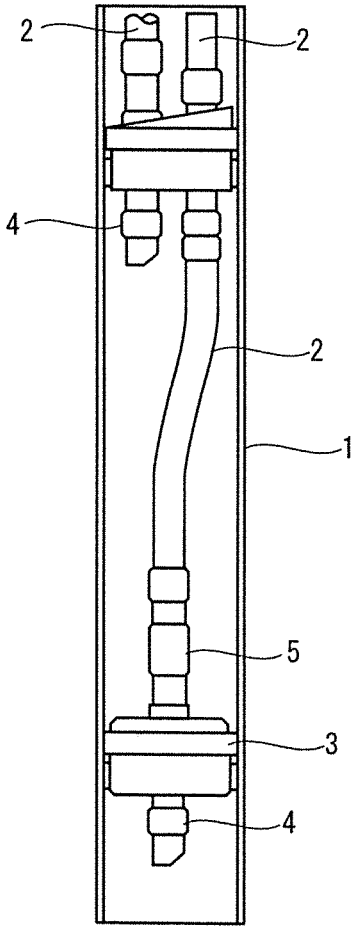
FIG. 1 is a view illustrating an example of oil country tubular goods and downhole members that are used in an oil well environment.

The present inventors conducted investigations and studies regarding the SCC resistance and SSC resistance of steel bars for downhole members. As a result, the present inventors obtained the following findings.

When producing stainless steel materials for oil wells, quenching and tempering are performed to adjust the strength. A downhole member is produced from a steel bar, which is solid, and not from a steel pipe that is hollow. When performing tempering of a steel bar, which is solid, it is necessary to set a longer tempering time in comparison to when tempering a steel pipe that is hollow. The reason is as follows.

A center section in a cross-section perpendicular to an axial direction (lengthwise direction) of a steel bar is liable to have a microstructure that is different from other locations due to segregation that occurs when producing the steel or the like. Most actual downhole members are produced by hollowing out the center section of a steel bar. However, depending on the downhole member, there are also cases in which the downhole member is used in a state in which the center section of the steel bar has not been hollowed out. In a case where the center section of the steel bar remains, the microstructure of the center section can significantly influence the performance of the downhole member. Therefore, it is preferable that the microstructure of a center section in a cross-section perpendicular to the lengthwise direction of the downhole member is homogenous with the microstructure around the center section. Therefore, the tempering time is made longer in comparison to the case of a steel pipe so that a region from the surface to the center section in a cross-section perpendicular to the lengthwise direction of steel bar becomes, as much as possible, a homogeneous microstructure.

However, when the tempering time for a steel bar composed of stainless steel is long, various precipitates including intermetallic compounds such as Laves phase compounds (hereunder, referred to simply as "Laves phase") precipitate. Laves phase contains Mo that is an element that increases corrosion resistance. Therefore, if Laves phase is formed, the dissolved Mo amount in the base material decreases. If the dissolved Mo amount in the base material decreases, the SCC resistance and SSC resistance of the downhole member will decrease. Accordingly, if the precipitation of Laves phase can be inhibited, a decrease in the dissolved Mo amount in the base material can be suppressed and the SCC resistance and the SSC resistance will increase.

In order to inhibit precipitation of Laves phase, a method may be considered which raises the content of N that is an austenite-forming element. However in this case, the strength of the steel material is increased by dissolved N. Therefore, it is necessary to further lengthen the tempering time. If the tempering time is lengthened, as described above, the amount of Laves-phase precipitates will increase. Therefore, the present inventors conducted studies regarding steel bars for a downhole member in which formation of Laves phase can be inhibited even when tempering is performed for a long time period, and which is excellent in SCC resistance and SSC resistance. As a result, the present inventors obtained the following findings.

[Reduction of Laves Phase by Containing Cu]

In the present embodiment, with respect to a steel bar for a downhole member containing C: 0.020% or less, Si: 1.0% or less, Mn: 1.0% or less, P: 0.03% or less, S: 0.01% or less, Cr: 10 to 14%, Ni: 1.5 to 7.0%, Mo: 0.2 to 3.0%, Ti: 0.05 to 0.3%, V: 0.01 to 0.10%, Nb: 0.1% or less, Al: 0.001 to 0.1%, and N: 0.05% or less, rather than increasing the N content, Cu that is an austenite-forming element similarly to N is contained in an amount of 0.10 to 2.50 by mass %. In this case, in a stainless steel bar having the aforementioned chemical composition, the amount of Laves-phase precipitates is reduced by containing Cu. Furthermore, because Cu does not increase the strength of the steel material to the same extent as dissolved N, the tempering time can be kept shorter. If the Cu content is from 0.10 to 2.50%, these effects can be adequately obtained.

[Dissolved Mo Amount Necessary to Obtain Adequate SCC Resistance and SSC Resistance]

The Mo content in the chemical composition of a steel bar for a downhole member is defined as [Mo amount] (mass %), and the Mo content in precipitate at a position (hereunder, referred to as "R/2 position") that bisects a radius from the surface of the steel bar for a downhole member to the center of the steel bar for a downhole member in a cross-section perpendicular to the lengthwise direction of the steel bar for a downhole member is defined as [total Mo amount in precipitate at R/2 position] (mass %). Here, the term "Mo content in precipitate" means the total content (mass %) of Mo in precipitate in a case where the total mass of precipitate in the microstructure at the R/2 position is taken as 100% (mass %). At this time, the steel bar for a downhole member having the aforementioned chemical composition also satisfies Formula (1).

[Mo amount]−4×[total Mo amount in precipitate at R/2 position]≥1.3 (1)

Figure 2:
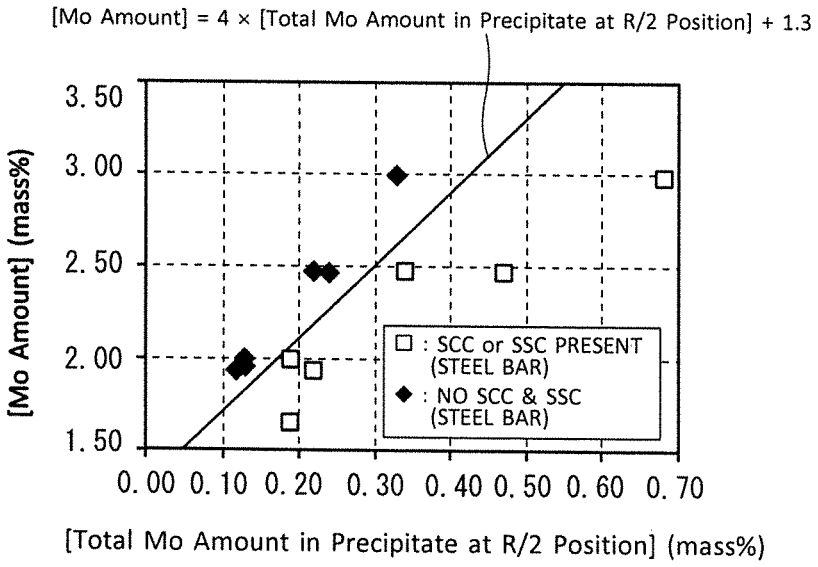
FIG. 2 is a view illustrating the relation between an Mo content of a chemical composition of a steel bar for a downhole member, an Mo content in precipitate (intermetallic compounds such as Laves phase) at an R/2 position of a steel bar for a downhole member ([total Mo amount in precipitate at R/2 position]), and corrosion resistance (SCC resistance and SSC resistance).

FIG. 2 is a view illustrating the relation between the Mo content ([Mo amount]) in the chemical composition of a steel bar for a downhole member, the Mo content in precipitate at the R/2 position ([total Mo amount in precipitate at R/2 position]), and corrosion resistance (SCC resistance and SSC resistance). FIG. 2 was obtained by means of examples that are described later.

Referring to FIG. 2, the mark "◆" in the drawing indicates that, in an SCC resistance evaluation test and an SSC resistance evaluation test, neither of SCC nor SSC were observed (that is, the steel material is excellent in SCC resistance and SSC resistance). The mark "□" in the drawing indicates that either SCC or SSC was observed in an SCC resistance evaluation test and an SSC resistance evaluation test (that is, the SCC resistance and/or SSC resistance is low).

Referring to FIG. 2, if the Mo content ([Mo amount]) in the chemical composition of a steel bar is equal to or higher than a boundary line ([Mo amount]=4× [total Mo amount in precipitate at R/2 position]+1.3), that is, if Formula (1) is satisfied, a sufficient dissolved Mo amount can be secured in the base material, and excellent SCC resistance and SSC resistance is obtained.

[Inhibition of Formation of Coarse Laves Phase at Center Section by Microstructure Homogenization]

As described above, in a cross-section perpendicular to the lengthwise direction of a steel bar for a downhole member, the microstructure at the center section is preferably homogeneous with the microstructure of other regions as much as possible. This point is described hereunder.

The description will now focus on Mo segregation in a steel bar for a downhole member. In a cross-section perpendicular to the lengthwise direction of a steel bar for a downhole member, the center section corresponds to the final solidification position. At the final solidification position, a large amount of Cr and Mo segregates compared to other regions. In addition, the reduction rate during hot working tends to decrease at the center section compared to other regions. Therefore, the microstructure of the center section is more liable to become coarse grain compared to other regions. Laves phase precipitates at grain boundaries. Therefore, if the microstructure is coarse-grained, the Laves phase is liable to coarsen. If a large amount of coarse Laves phase precipitates, not only will the dissolved Mo amount in the base material decrease, but pitting that takes the coarse Laves phase as a starting point will occur, and consequently SCC and/or SSC will occur. If the grains of the microstructure of the center section at which Mo is liable to segregate are also refined in an equal manner to the regions other than the center section to thereby suppress coarsening of the Laves phase, the microstructure of the center section will become homogeneous with the microstructure of the regions other than the center section, and the dissolved Mo amount in the center section will be equal to the dissolved Mo amount in the regions other than the center section. In this case, excellent SCC resistance and SSC resistance is obtained in the entire steel bar for a downhole member.

The Mo content in precipitate at the center position in a cross-section perpendicular to the lengthwise direction of a steel bar for a downhole member is defined as [total Mo amount in precipitate at center position] (mass %). Here, the term "Mo content in precipitate" means the total content (mass %) of Mo in precipitate in a case where the total mass of precipitate in the microstructure at the center position is taken as 100% (mass %). In this case, the steel bar for a downhole member of the present embodiment has the aforementioned chemical composition, and on condition that the steel bar satisfies Formula (1), the steel bar also satisfies Formula (2).

$$[\text{Total Mo amount in precipitate at center position}]-[\text{total Mo amount in precipitate at R/2}]\leq 0.03 \quad (2)$$

By satisfying the requirements of the aforementioned chemical composition, and also satisfying Formula (1) and Formula (2), the steel bar for a downhole member of the present embodiment has excellent SCC resistance and SSC resistance at the center position and the R/2 position.

[One Example of Method for Producing Aforementioned Downhole Member]

The aforementioned steel bar for a downhole member can be produced, for example, by the following production method. A starting material having the aforementioned chemical composition is subjected to a hot working process, and thereafter a thermal refining process that includes quenching and tempering is performed.

In the hot working, in the case of performing free forging, the forging ratio is set to 4.0 or more, while in the case of performing rotary forging or hot rolling, the forging ratio is set to 6.0 or more. Here, the forging ratio is defined by Formula (A).

Forging ratio=sectional area ($mm^2$) of starting material before performing hot working/sectional area ($mm^2$) of starting material after completing hot working (A)

In addition, in the thermal refining process after hot working, in tempering that is performed after quenching, the Larson-Miller parameter LMP is set in the range of 16,000 to 18,000. The Larson-Miller parameter LMP is defined by Formula (B).

$$LMP=(T+273)\times(20+\log(t)) \quad (B)$$

The steel bar for a downhole member of the present embodiment which was completed based on the above findings has a chemical composition consisting of, by mass %, C: 0.020% or less, Si: 1.0% or less, Mn: 1.0% or less, P: 0.03% or less, S: 0.01% or less, Cu: 0.10 to 2.50%, Cr: 10 to 14%, Ni: 1.5 to 7.0%, Mo: 0.2 to 3.0%, Ti: 0.05 to 0.3%, V: 0.01 to 0.10%, Nb: 0.1% or less, Al: 0.001 to 0.1%, N: 0.05% or less, B: 0 to 0.005%, Ca: 0 to 0.008% and Co: 0 to 0.5%, with the balance being Fe and impurities. When an Mo content of the chemical composition of the steel bar for a downhole member is defined as [Mo amount] (mass %), and an Mo content in precipitate at a position that bisects a radius from the surface of the steel bar for a downhole member to the center of the steel bar for a downhole member in a cross-section perpendicular to a lengthwise direction of the steel bar for a downhole member is defined as [total Mo amount in precipitate at R/2 position] (mass %), the steel bar for a downhole member satisfies Formula (1). In addition, when an Mo content in precipitate at a center position in a cross-section perpendicular to the lengthwise direction of the steel bar for a downhole member is defined as [total Mo amount in precipitate at center position] (mass %), the steel bar for a downhole member satisfies Formula (2).

$$[\text{Mo amount}]-4\times[\text{total Mo amount in precipitate at R/2 position}]\geq 1.30 \quad (1)$$

$$[\text{Total Mo amount in precipitate at center position}]-[\text{total Mo amount in precipitate at R/2 position}]\leq 0.03 \quad (2)$$

The aforementioned chemical composition may contain one or more types of element selected from the group consisting of B: 0.0001 to 0.005% and Ca: 0.0001 to 0.008% in lieu of a part of Fe.

The aforementioned chemical composition may contain Co: 0.05 to 0.5% in lieu of a part of Fe.

The downhole member of the present embodiment has the aforementioned chemical composition. When an Mo content in the chemical composition of the downhole member is defined as [Mo amount] (mass %), and an Mo content in precipitate at a position that bisects a radius from the surface of the downhole member to the center of the downhole member in a cross-section perpendicular to a lengthwise direction of the downhole member is defined as [total Mo amount in precipitate at R/2 position] (mass %), the downhole member satisfies Formula (1).

$$[\text{Mo amount}]-4\times[\text{total Mo amount in precipitate at R/2 position}]\geq 1.3 \quad (1)$$

Hereunder, the steel bar for a downhole member of the present embodiment is described in detail. The symbol "%" in relation to an element means "mass %" unless specifically stated otherwise.

[Chemical Composition]

The chemical composition of the steel bar for a downhole member of the present embodiment contains the following elements.

C: 0.020% or less

Carbon (C) is unavoidably contained. Although C raises the strength of the steel, C forms Cr carbides during tempering. Cr carbides lower the corrosion resistance (SCC resistance and SSC resistance). Therefore, a low C content is preferable. The C content is 0.020% or less. A preferable upper limit of the C content is 0.015%, more preferably is 0.012%, and further preferably is 0.010%.

Si: 1.0% or less

Silicon (Si) is unavoidably contained. Si deoxidizes the steel. However, if the Si content is too high, hot workability decreases. In addition, the amount of ferrite formation increases, and the strength of the steel material decreases. Therefore the Si content is 1.0% or less. A preferable Si content is less than 1.0%, more preferably is 0.50% or less, and further preferably is 0.30% or less. If the Si content is 0.05% or more, the Si acts particularly effectively as a deoxidizer. However, even if the Si content is less than 0.05%, the Si will deoxidize the steel to a certain extent.

Mn: 1.0% or less

Manganese (Mn) is unavoidably contained. Mn deoxidizes and desulfurizes the steel, and improves the hot workability. However, if the Mn content is too high, segregation is liable to occur in the steel, and the toughness as well as the SCC resistance in a high-temperature chloride aqueous solution decreases. In addition, Mn is an austenite-forming element. Therefore, in a case where the steel contains Ni and Cu that are austenite-forming elements, if the Mn content is too high, the amount of retained austenite increases and the strength of the steel decreases. Therefore, the Mn content is 1.0% or less. A preferable lower limit of the Mn content is 0.10%, and more preferably is 0.30%. A preferable upper limit of the Mn content is 0.8%, and more preferably is 0.5%.

P: 0.03% or less

Phosphorus (P) is an impurity. P lowers the SSC resistance and the SCC resistance of the steel. Therefore, the P content is 0.03% or less. A preferable upper limit of the P content is 0.025%, and more preferably is 0.022%, and further preferably is 0.020%. The P content is preferably as low as possible.

S: 0.01% or less

Sulfur (S) is an impurity. S decreases the hot workability of the steel. S also combines with Mn and the like to form inclusions. The formed inclusions become starting points for SCC or SSC, and thereby lower the corrosion resistance of the steel. Therefore, the S content is 0.01% or less. A preferable upper limit of the S content is 0.0050%, more preferably is 0.0020%, and further preferably is 0.0010%. The S content is preferably as low as possible.

Cu: 0.10 to 2.50%

Copper (Cu) suppresses formation of Laves phase. Although the reason therefor is uncertain, it is considered that the reason may be as follows. Cu finely disperses as Cu particles in the matrix. Formation and growth of Laves phase is inhibited by a pinning effect of the dispersed Cu particles. By this means, the amount of Laves-phase precipitates is kept low, and a decrease in the dissolved Mo amount is suppressed. As a result, in the steel bar, the SCC resistance and SSC resistance increase. This effect is not obtained if the Cu content is too low. On the other hand, if the Cu content is too high, center segregation of Cr and Mo is excessively promoted, and consequently Formula (2) is not satisfied. In such case, excellent SCC resistance and SSC resistance in the entire steel bar for a downhole member is sometimes not obtained. If the Cu content is high, the hot workability of the steel material also decreases. Therefore, the Cu content is 0.10 to 2.50%. A preferable lower limit of the Cu content is 0.15%, and more preferably is 0.17%. A preferable upper limit of the Cu content is 2.00%, more preferably is 1.50%, and further preferably is 1.20%.

Cr: 10 to 14%

Chromium (Cr) raises the SCC resistance and SSC resistance of the steel. If the Cr content is too low, this effect is not obtained. On the other hand, Cr is a ferrite-forming element. Therefore, if the Cr content is too high, ferrite forms in the steel and the yield strength of the steel decreases. Therefore, the Cr content is 10 to 14%. A preferable lower limit of the Cr content is 11%, more preferably is 11.5%, and further preferably is 11.8%. A preferable upper limit of the Cr content is 13.5%, more preferably is 13.0%, and further preferably is 12.5%.

Ni: 1.5 to 7.0%

Nickel (Ni) is an austenite-forming element. Therefore, Ni stabilizes austenite in the steel at a high temperature, and increases the martensite amount at normal temperature. By this means, Ni increases the steel strength. Ni also increases the corrosion resistance (SCC resistance and SSC resistance) of the steel. If the Ni content is too low, these effects are not obtained. On the other hand, if the Ni content is too high, the amount of retained austenite is liable to increase, and particularly at the time of industrial production it becomes difficult to stably obtain a high-strength steel bar for a downhole member. Therefore, the Ni content is 1.5 to 7.0%. A preferable lower limit of the Ni content is 3.0%, and more preferably is 4.0%. A preferable upper limit of the Ni content is 6.5%, and more preferably is 6.2%.

Mo: 0.2 to 3.0%

When the production of a production fluid temporarily stops in an oil well, the temperature of fluid inside the oil country tubular goods decreases. At this time, the sulfide stress-corrosion cracking susceptibility of downhole members increases. Molybdenum (Mo) raises the SSC resistance. Mo also raises the SCC resistance of steel when coexistent with Cr. If the Mo content is too low, these effects are not obtained. On the other hand, because Mo is a ferrite-forming element, if the Mo content is too high, ferrite forms in the steel and the steel strength decreases. Therefore the Mo content is 0.2 to 3.0%. A preferable lower limit of the Mo content is 1.0%, more preferably is 1.5%, and further preferably is 1.8%. A preferable upper limit of the Mo content is 2.8%, more preferably is less than 2.8%, further preferably is 2.7%, more preferably is 2.6%, and further preferably is 2.5%.

Ti: 0.05 to 0.3%

Titanium (Ti) forms carbides and increases the strength and toughness of the steel. If the diameter of the steel bar for a downhole member is large, Ti carbides also reduce variation in the strength of the steel bar for a downhole member. Ti also fixes C and inhibits the formation of Cr carbides, thereby raising the SCC resistance. These effects are not obtained if the Ti content is too low. On the other hand, if the Ti content is too high, carbides coarsen and the toughness and corrosion resistance of the steel decreases. Therefore, the Ti content is 0.05 to 0.3%. A preferable lower limit of the Ti content is 0.06%, more preferably is 0.08%, and further preferably is 0.10%. A preferable upper limit of the Ti content is 0.2%, more preferably is 0.15%, and further preferably is 0.12%.

V: 0.01 to 0.10%

Vanadium (V) forms carbides and increases the strength and toughness of the steel. V also fixes C and inhibits the formation of Cr carbides, thereby raising the SCC resistance. These effects are not obtained if the V content is too low. On the other hand, if the V content is too high, carbides coarsen and the toughness and corrosion resistance of the steel decreases. Therefore, the V content is 0.01 to 0.10%. A preferable lower limit of the V content is 0.03%, and more preferably is 0.05%. A preferable upper limit of the V content is 0.08%, and more preferably is 0.07%.

Nb: 0.1% or less

Niobium (Nb) is an impurity. Although Nb forms carbides and has an effect of increasing the strength and toughness of the steel material, if the Nb content is too high, carbides coarsen and the toughness and corrosion resistance of the steel material decreases. Therefore, the Nb content is 0.1% or less. A preferable upper limit of the Nb content is 0.05%, more preferably is 0.02%, and further preferably is 0.01%.

Al: 0.001 to 0.1%

Aluminum (Al) deoxidizes the steel. If the Al content is too low, this effect is not obtained. On the other hand, if the Al content is too high, the amount of ferrite in the steel increases, and the steel strength decreases. In addition, a large amount of alumina-based inclusions are formed in the steel, and the toughness of the steel material decreases. Therefore, the Al content is 0.001 to 0.1%. A preferable lower limit of the Al content is 0.005%, more preferably is 0.010%, and further preferably is 0.020%. A preferable upper limit of the Al content is 0.080%, more preferably is 0.060%, and further preferably is 0.050%. Note that, in the steel bar of the present embodiment, the Al content means the acid-soluble Al (sol. Al) content.

N: 0.05% or less

Nitrogen (N) is an impurity. Although N has an effect of increasing the strength of the steel, if the N content is too high the steel toughness will decrease and the strength of the steel material will become excessively high. In such case, the tempering time must be lengthened to adjust the strength, and Laves phase formation is liable to occur. If Laves phase forms, the dissolved Mo amount will decrease, and the SCC resistance and SSC resistance will decrease. Therefore, the N content is 0.05% or less. A preferable upper limit of the N content is 0.030%, more preferably is 0.020% and further preferably is 0.010%.

The balance of the chemical composition of the steel bar according to the present embodiment is Fe and impurities. Here, the term "impurities" refers to elements which, during industrial production of the steel bar for a downhole member, are mixed in from ore or scrap used as a raw material or from the production environment or the like, and which are allowed to be contained in an amount within a range that does not adversely affect the steel bar of the present embodiment.

[Regarding Optional Elements]

The steel bar of the present embodiment may further contain one or more types of element selected from the group consisting of B and Ca in lieu of a part of Fe. Each of these elements is an optional element, and is each an element that suppresses the occurrence of flaws and defects during hot working.

B: 0 to 0.005%

Ca: 0 to 0.008%

Boron (B) and calcium (Ca) are each an optional element, and need not be contained. When contained, B and Ca each suppress the occurrence of flaws and defects during hot working. The aforementioned effect is obtained to a certain extent if even a small amount of at least one type of element among B and Ca is contained. On the other hand, if the B content is too high, Cr carbo-borides precipitate at the grain boundaries, and the toughness of the steel decreases. Further, if the Ca content is too high, inclusions in the steel increase, and the toughness and corrosion resistance of the steel decreases. Therefore, the B content is 0 to 0.005%, and the Ca content is 0 to 0.008%. A preferable lower limit of the B content is 0.0001%, and a preferable upper limit is 0.0002%. A preferable lower limit of the Ca content is 0.0005%, and a preferable upper limit is 0.0020%.

The steel bar material of the present embodiment may further contain Co in lieu of a part of Fe.

Co: 0 to 0.5%

Cobalt (Co) is an optional element, and need not be contained. When contained, Co increases the hardenability of the steel and ensures stable high strength, particularly at the time of industrial production. More specifically, Co inhibits the occurrence of retained austenite, and suppresses variations in the steel strength. If even a small amount of Co is contained, the aforementioned effect is obtained to a certain extent. However, if the Co content is too high, the toughness of the steel decreases. Therefore, the Co content is 0 to 0.5%. A preferable lower limit of the Co content is 0.05%, more preferably is 0.07%, and further preferably is 0.10%. A preferable upper limit of the Co content is 0.40%, more preferably is 0.30%, and further preferably is 0.25%.

[Regarding Formula (1)]

In the steel bar for a downhole member of the present embodiment, the [Mo amount] (mass %) and the [total Mo amount in precipitate at R/2 position] (mass %) are defined as follows.

[Mo amount]: Mo content (mass %) in chemical composition of the steel bar for a downhole member

[Total Mo amount in precipitate at R/2 position]: total Mo content (mass %) in precipitate in a case where the total mass of precipitate in the microstructure at a position (hereunder, referred to as "R/2 position") that bisects a radius from the surface to the center of the steel bar for a downhole member in a cross-section perpendicular to the lengthwise direction of the steel bar for a downhole member is taken as 100%

In this case, the [Mo amount] specified in the chemical composition of the steel bar for a downhole member, and the [total Mo amount in precipitate at R/2 position] specified for the microstructure at the R/2 position satisfy Formula (1).

$$[\text{Mo amount}]-4\times[\text{total Mo amount in precipitate at R/2 position}]\geq 1.30 \quad (1)$$

It is defined that F1=[Mo amount]−4×[total Mo amount in precipitate at R/2 position]. F1 is an index of the dissolved Mo amount in the steel bar for a downhole member. When the steel bar for a downhole member is viewed from a macro standpoint, the total Mo amount in precipitate at the R/2 position means the Mo amount absorbed in Laves phase. If F1 is 1.30 or more, an adequate amount of dissolved Mo is present. Therefore, as shown in FIG. 2, excellent SCC resistance and SSC resistance are obtained. A preferable lower limit of F1 is 1.40, and more preferably is 1.45.

The [Mo amount] is the Mo content (%) in the chemical composition. Therefore, the [Mo amount] can be determined by a well-known component analysis method. Specifically, for example, the [Mo amount] can be determined by the following method. The steel bar for a downhole member is cut perpendicularly to the lengthwise direction thereof, and a sample with a length of 20 mm is extracted. The sample is made into machined chips which are then dissolved in acid to obtain a liquid solution. The liquid solution is subjected to ICP-OES (Inductively Coupled Plasma Optical Emission Spectrometry), and elementary analysis of the chemical composition is performed. Note that, with respect to the C content and S content in the chemical composition, specifically, for example, the C content and S content are determined by combusting the aforementioned liquid solution in an oxygen gas flow by high-frequency heating, and detecting generated carbon dioxide and sulfur dioxide.

On the other hand, the [total Mo amount in precipitate at R/2 position] is measured by the following method. A sample (diameter of 9 mm×length of 70 mm) that includes the R/2 position is extracted at an arbitrary cross-section that is perpendicular to the lengthwise direction of the steel bar for a downhole member. The lengthwise direction of the sample is parallel to the lengthwise direction of the steel bar for a downhole member, and the center of a transverse section (circle with a diameter of 9 mm) of the sample is taken as the R/2 position of the steel bar for a downhole member. The specimen is electrolyzed using a 10% AA-based electrolytic solution (10% acetylacetone-1% tetramethylammonium chloride-methanol electrolytic solution). The current during electrolysis is set to 20 mA/cm$^2$. The electrolytic solution is filtrated using a 200-nm filter, and the mass of the residue is measured to determine the [total mass of precipitate at R/2 position]. In addition, the Mo amount contained in a solution in which the residue was subjected to acid decomposition is determined by ICP emission spectrometry. Based on the Mo amount and the [total mass of precipitate at R/2 position] in the solution, the total Mo content (mass %) in precipitate when the total mass of precipitate at the R/2 position is taken as 100 (mass %) is determined. Five of the aforementioned samples (diameter of 9 mm and length of 70 mm) of the round bar are extracted at regions that include the R/2 position at arbitrary locations, and the average value of the total Mo content in precipitate determined from the respective samples is defined as the [total Mo amount in precipitate at R/2 position] (mass %).

[Regarding Formula (2)]

The total Mo content (mass %) in precipitate in a case where the total mass of precipitate at the center position in a cross-section perpendicular to the lengthwise direction of the steel bar for a downhole member is taken as 100 (mass %) is defined as [total Mo amount in precipitate at center position] (mass %). At this time, on condition that the steel bar for a downhole member of the present embodiment has the aforementioned chemical composition and satisfies Formula (1), the steel bar for a downhole member also satisfies Formula (2).

$$[\text{Total Mo amount in precipitate at center position}] - [\text{total Mo amount in precipitate at R/2 position}] \leq 0.03 \quad (2)$$

It is defined that F2=[total Mo amount in precipitate at center position]-[total Mo amount in precipitate at R/2 position]. F2 is an index that relates to the homogeneity of the microstructure in a cross-section perpendicular to the lengthwise direction of the steel bar for a downhole member. If F2 is 0.03 or less, it means that the amount of Laves phase precipitation at the center position is approximately equal to the amount of Laves phase precipitation at the R/2 position. This means that the grain size in the microstructure at the center position is approximately equal to the grain size in the microstructure at the R/2 position, and the microstructure is substantially homogeneous in a cross-section perpendicular to the lengthwise direction of the steel bar for a downhole member. Accordingly, this means that, in the steel bar for a downhole member, excellent SCC resistance and SSC resistance are obtained at both the R/2 position and the center position, and excellent SCC resistance and SSC resistance are obtained over the entire cross-section perpendicular to the lengthwise direction of the steel bar for a downhole member. A preferable upper limit of F2 is 0.02, and more preferably is 0.01.

The [total Mo amount in precipitate at center position] is measured by the following method. A sample (diameter of 9 mm×length of 70 mm) that includes the center position is extracted at an arbitrary cross-section that is perpendicular to the lengthwise direction of the steel bar for a downhole member. The lengthwise direction of the sample is parallel to the lengthwise direction of the steel bar for a downhole member, and the center of a transverse section (circle with a diameter of 9 mm) of the sample is taken as the center position in a cross-section perpendicular to the lengthwise direction of the steel bar for a downhole member. The specimen is electrolyzed using a 10% AA-based electrolytic solution (10% acetylacetone-1% tetramethylammonium chloride-methanol electrolytic solution). The current during electrolysis is set to 20 mA/cm$^2$. The electrolytic solution is filtrated using a 200-nm filter, and the mass of the residue is measured to determine [total mass of precipitate at center position]. In addition, the Mo amount contained in a solution in which the residue was subjected to acid decomposition is determined by ICP emission spectrometry. Based on the Mo amount and the [total mass of precipitate at center position] in the solution, the total Mo content (mass %) in precipitate when the total mass of precipitate at the center position is taken as 100 (mass %) is determined. Five samples are extracted at arbitrary places, and the average value of the total Mo content in precipitate determined from the respective samples is defined as the [total Mo amount in precipitate at center position] (mass %).

The steel bar for a downhole member of the present embodiment has the aforementioned chemical composition, and Cu content is 0.10 to 2.50%. In addition, on the condition of satisfying the requirements of the aforementioned chemical composition, the steel bar for a downhole member satisfies Formula (1) and Formula (2). Therefore, a sufficient amount of dissolved Mo can be secured in the base material, and the steel bar for a downhole member has a homogeneous microstructure at the center section and in an R/2 portion. As a result, excellent SCC resistance and SSC resistance is obtained at the center section and the R/2 portion.

[Production Method]

It is possible to produce the steel bar for a downhole member of the present embodiment, for example, by the following production method. However, a method for producing the downhole member of the present embodiment is not limited to the present example. Hereunder, one example of a method for producing the steel bar for the downhole member of the present embodiment is described. The present production method includes a process of producing an intermediate material (billet) by hot working (hot working process), and a process (thermal refining process) of subjecting the intermediate material to quenching and tempering to adjust the strength and form a steel bar for a downhole member. Each process is described hereunder.

[Hot Working Process]

An intermediate material having the aforementioned chemical composition is prepared. Specifically, molten steel having the aforementioned chemical composition is produced. A starting material is produced using the molten steel. A cast piece as a starting material may also be produced by a continuous casting process. An ingot as a starting material may be produced using the molten steel.

The produced starting material (cast piece or ingot) is heated. Hot working is performed on the heated starting material to produce an intermediate material. The hot working is, for example, free forging, rotary forging or hot rolling. The hot rolling may be billeting, or may be rolling that uses a continuous mill that includes a plurality of roll stands arranged in a single row.

In the hot working, the forging ratio is defined by the following formula.

Forging ratio=sectional area ($mm^2$) of starting material before performing hot working/sectional area ($mm^2$) of starting material after completing hot working (A)

The "sectional area of starting material before performing hot working" in Formula (A) is defined as a sectional area ($mm^2$) with the smallest area among cross-sections perpendicular to the lengthwise direction of the starting material in a starting material portion (referred to as a "starting material main body portion") that excludes a region (front end portion) of 1000 mm in the axial direction of the starting material from the front end of the starting material and a region (rear end portion) of 1000 mm in the axial direction of the starting material from the rear end of the starting material.

When the hot working is free forging, the forging ratio is set as 4.0 or more. Further, when the hot working is rotary forging or hot rolling, the forging ratio is set as 6.0 or more. If the forging ratio in free forging is less than 4.0, or if the forging ratio in rotary forging or hot rolling is less than 6.0, it is difficult for the rolling reduction in the hot working to penetrate as far as the center section of a cross-section perpendicular to the lengthwise direction of the starting material. In such case, the microstructure at the center position of a cross-section perpendicular to the lengthwise direction of the steel bar for a downhole member becomes coarser than the microstructure at the R/2 position, and F2 does not satisfy Formula (2). If the forging ratio in free forging is 4.0 or more, or if the forging ratio in rotary forging or hot rolling is 6.0 or more, the reduction in the hot working sufficiently penetrates as far as the center section of the starting material. Therefore, the grain size in the microstructure at the center position of the steel bar for a downhole member becomes substantially equal to the grain size in the microstructure at the R/2 position, and F2 satisfies Formula (2). A preferable forging ratio FR in free forging is 4.2 or more, more preferably is 5.0 or more, and further preferably is 6.0 or more. A preferable forging ratio FR in rotary forging or hot rolling is 6.2 or more, and more preferably is 6.5 or more.

[Thermal Refining Process]

The intermediate material is subjected to thermal refining (thermal refining process). The thermal refining process includes a quenching process and a tempering process.

[Quenching Process]

A well-known quenching is performed on the intermediate material produced by the hot working process. The quenching temperature during quenching is equal to or higher than the $Ac_3$ transformation point. For the intermediate material having the aforementioned chemical composition, a preferable lower limit of the quenching temperature is 800° C. and a preferable upper limit is 1000° C.

[Tempering Process]

After undergoing the quenching process, the intermediate material is subjected to tempering. A preferable tempering temperature T is in the range of 550 to 650° C. A preferable holding time at the tempering temperature T is 4 to 12 hours.

In addition, the Larson-Miller parameter LMP for the tempering process is in the range of 16,000 to 18,000. The Larson-Miller parameter is defined by Formula (B).

$$LMP=(T+273)\times(20+\log(t)) \quad (B)$$

In Formula (B), "T" represents the tempering temperature (° C.), and "t" represents the holding time (hr) at the tempering temperature T.

If the Larson-Miller parameter LMP is too small, strain will remain in the steel material because the tempering is insufficient. Consequently, the desired mechanical characteristics will not be obtained. Specifically, the strength will be too high, and as a result the SCC resistance and SSC resistance will decrease. Therefore, a preferable lower limit of the Larson-Miller parameter LMP is 16,000. On the other hand, if the Larson-Miller parameter LMP is too high, an excessively large amount of Laves phase will form. As a result, F1 will not satisfy Formula (1). In such case, the SCC resistance and SSC resistance will be low. Accordingly, the upper limit of the Larson-Miller parameter LMP is 18,000. A preferable lower limit of the Larson-Miller parameter LMP is 16,500, more preferably is 17,000, and further preferably is 17,500. A preferable upper limit of the Larson-Miller parameter LMP is 17,970, and more preferably is 17,940.

The aforementioned steel bar for a downhole member is produced by the production process described above.

[Downhole Member]

The downhole member according to the present embodiment is produced using the aforementioned steel bar for a downhole member. Specifically, the steel bar for a downhole member is subjected to a cutting process to produce a downhole member of a desired shape.

The downhole member has the same chemical composition as the steel bar for a downhole member. In addition, when the Mo content of the chemical composition of the downhole member is defined as [Mo amount] (mass %), and the Mo content in precipitate at a position that bisects a radius from the surface of the downhole member to the center of the downhole member in a cross-section perpendicular to the lengthwise direction of the downhole member is defined as [total Mo amount in precipitate at R/2 position] (mass %), the downhole member satisfies Formula (1).

[Mo amount]−4×[total Mo amount in precipitate at R/2 position]≥1.3 (1)

The downhole member having the above structure has, in a cross-section perpendicular to the lengthwise direction, a homogeneous microstructure in which a sufficient amount of dissolved Mo is secured. Therefore, the downhole member has excellent SCC resistance and SSC resistance over the entire cross-section perpendicular to the lengthwise direction. Note that, in the downhole member, in a case where the center section of the steel bar for a downhole member remains, the downhole member satisfies not only the aforementioned Formula (1), but also Formula (2).

EXAMPLES

Molten steel having the chemical compositions shown in Table 1 were produced. The symbol "-" in Table 1 means that the content of the corresponding element is a value that is less than the measurement limit.

TABLE 1

| | Test | Chemical Composition (unit is mass %; balance is Fe and impurities) | | | | | | | | |
|---|---|---|---|---|---|---|---|---|---|---|
| Remarks | Number | C | Si | Mn | P | S | Cu | Cr | Ni | Mo |
| Invention Examples | 1 | 0.009 | 0.30 | 0.44 | 0.022 | 0.0005 | 0.18 | 11.85 | 5.53 | 1.99 |
| | 2 | 0.011 | 0.23 | 0.40 | 0.015 | 0.0006 | 0.17 | 12.05 | 5.57 | 1.93 |
| | 3 | 0.012 | 0.23 | 0.41 | 0.016 | 0.0005 | 0.18 | 12.06 | 5.65 | 1.95 |
| | 4 | 0.010 | 0.21 | 0.43 | 0.014 | 0.0006 | 1.08 | 12.11 | 6.08 | 2.47 |

TABLE 1-continued

| | | | | | | | | | | |
|---|---|---|---|---|---|---|---|---|---|---|
| | 5 | 0.010 | 0.23 | 0.42 | 0.014 | 0.0005 | 1.08 | 12.12 | 6.08 | 2.49 |
| | 6 | 0.010 | 0.26 | 0.46 | 0.013 | 0.0005 | 2.16 | 11.07 | 6.92 | 2.99 |
| | 7 | 0.009 | 0.25 | 0.44 | 0.015 | 0.0005 | 0.18 | 12.06 | 5.65 | 2.11 |
| | 8 | 0.010 | 0.24 | 0.43 | 0.015 | 0.0005 | 0.18 | 11.95 | 5.50 | 2.01 |
| | 9 | 0.010 | 0.24 | 0.43 | 0.015 | 0.0005 | 0.19 | 11.93 | 5.69 | 2.00 |
| | 10 | 0.010 | 0.26 | 0.44 | 0.017 | 0.0005 | 0.18 | 12.00 | 5.61 | 1.96 |
| | 11 | 0.009 | 0.24 | 0.44 | 0.014 | 0.0005 | 0.18 | 11.96 | 5.51 | 2.02 |
| | 12 | 0.010 | 0.23 | 0.41 | 0.016 | 0.0005 | 0.20 | 11.86 | 5.51 | 2.00 |
| Comparative | 13 | 0.025 | 0.22 | 0.33 | 0.012 | 0.0015 | — | 12.20 | 5.35 | 1.93 |
| Examples | 14 | 0.017 | 0.32 | 0.77 | 0.017 | 0.0002 | 0.06 | 13.47 | 4.74 | 1.65 |
| (Steel Bar) | 15 | 0.009 | 0.21 | 0.42 | 0.014 | 0.0006 | 0.19 | 11.81 | 5.60 | 1.99 |
| | 16 | 0.010 | 0.22 | 0.43 | 0.014 | 0.0005 | 1.08 | 12.12 | 6.08 | 2.47 |
| | 17 | 0.010 | 0.26 | 0.46 | 0.013 | 0.0006 | 1.09 | 12.10 | 6.08 | 2.47 |
| | 18 | 0.010 | 0.26 | 0.46 | 0.013 | 0.0005 | 2.15 | 11.07 | 6.92 | 2.98 |
| | 19 | 0.010 | 0.24 | 0.40 | 0.016 | 0.0005 | 2.65 | 12.06 | 5.30 | 2.01 |
| | 20 | 0.010 | 0.25 | 0.42 | 0.015 | 0.0005 | 0.06 | 12.00 | 5.65 | 2.00 |
| | 21 | 0.009 | 0.28 | 0.44 | 0.019 | 0.0005 | 0.25 | 11.95 | 5.51 | 1.99 |
| | 22 | 0.010 | 0.24 | 0.41 | 0.015 | 0.0005 | 0.22 | 12.05 | 5.57 | 1.93 |
| Reference | 23 | 0.007 | 0.23 | 0.42 | 0.013 | 0.0006 | 0.02 | 11.88 | 6.93 | 2.99 |
| Examples | 24 | 0.018 | 0.21 | 0.43 | 0.014 | 0.0009 | 0.04 | 12.26 | 7.04 | 3.07 |
| (Steel Pipe) | 25 | 0.008 | 0.19 | 0.40 | 0.011 | 0.0005 | 0.04 | 12.02 | 7.06 | 3.00 |
| | 26 | 0.010 | 0.26 | 0.46 | 0.014 | 0.0006 | 0.03 | 11.80 | 6.93 | 3.00 |

| | Test | Chemical Composition (unit is mass %; balance is Fe and impurities) | | | | | | | |
|---|---|---|---|---|---|---|---|---|---|
| Remarks | Number | Ti | V | Nb | Sol. Al | N | B | Co | Ca |
| Invention | 1 | 0.103 | 0.060 | 0.001 | 0.031 | 0.0071 | 0.0002 | 0.180 | 0.0007 |
| Examples | 2 | 0.096 | 0.060 | 0.004 | 0.030 | 0.0068 | 0.0001 | 0.210 | 0.0010 |
| | 3 | 0.099 | 0.060 | 0.004 | 0.029 | 0.0071 | 0.0001 | 0.200 | 0.0008 |
| | 4 | 0.098 | 0.050 | 0.003 | 0.037 | 0.0070 | 0.0003 | 0.184 | 0.0009 |
| | 5 | 0.099 | 0.050 | 0.002 | 0.025 | 0.0071 | 0.0001 | 0.174 | 0.0012 |
| | 6 | 0.102 | 0.050 | 0.003 | 0.032 | 0.0062 | 0.0001 | 0.204 | 0.0009 |
| | 7 | 0.099 | 0.05 | 0.002 | 0.028 | 0.0067 | — | — | — |
| | 8 | 0.099 | 0.06 | 0.002 | 0.029 | 0.0068 | 0.0002 | — | — |
| | 9 | 0.104 | 0.05 | 0.002 | 0.038 | 0.0066 | — | 0.181 | — |
| | 10 | 0.105 | 0.05 | 0.001 | 0.032 | 0.0070 | 0.0002 | 0.180 | — |
| | 11 | 0.105 | 0.06 | 0.001 | 0.037 | 0.0070 | — | — | 0.0007 |
| | 12 | 0.098 | 0.05 | 0.002 | 0.036 | 0.0073 | 0.0001 | 0.195 | 0.0010 |
| Comparative | 13 | 0.010 | 0.160 | 0.006 | 0.001 | 0.0660 | 0.0001 | — | 0.0005 |
| Examples | 14 | — | 0.037 | <0.001 | 0.002 | 0.0117 | 0.0001 | — | 0.0001 |
| (Steel Bar) | 15 | 0.102 | 0.050 | 0.003 | 0.031 | 0.0082 | 0.0001 | 0.120 | 0.0006 |
| | 16 | 0.098 | 0.050 | 0.004 | 0.030 | 0.0072 | 0.0001 | 0.183 | 0.0006 |
| | 17 | 0.099 | 0.050 | 0.002 | 0.025 | 0.0072 | 0.0002 | 0.174 | 0.0007 |
| | 18 | 0.102 | 0.050 | 0.004 | 0.025 | 0.0068 | 0.0002 | 0.198 | 0.0009 |
| | 19 | 0.104 | 0.050 | 0.004 | 0.037 | 0.0069 | 0.0002 | 0.170 | 0.0012 |
| | 20 | 0.099 | 0.050 | 0.003 | 0.032 | 0.0067 | 0.0002 | 0.185 | 0.0011 |
| | 21 | 0.101 | 0.050 | 0.001 | 0.031 | 0.0070 | 0.0002 | 0.181 | 0.0007 |
| | 22 | 0.094 | 0.050 | 0.002 | 0.030 | 0.0068 | 0.0001 | 0.192 | 0.0009 |
| Reference | 23 | 0.092 | 0.040 | 0.004 | 0.025 | 0.0090 | 0.0003 | 0.220 | 0.0006 |
| Examples | 24 | 0.100 | 0.040 | 0.002 | 0.024 | 0.0062 | 0.0001 | 0.076 | 0.0007 |
| (Steel Pipe) | 25 | 0.093 | 0.030 | 0.001 | 0.025 | 0.0069 | 0.0001 | — | 0.0012 |
| | 26 | 0.091 | 0.040 | 0.003 | 0.032 | 0.0068 | 0.0002 | 0.220 | 0.0008 |

In test numbers 1 to 22, a cast piece was produced by a continuous casting process. Hot working (one of free forging, rotary forging and hot rolling) shown in Table 2 was performed on the cast piece, and a solid-core intermediate material (steel bar) in which a cross-section perpendicular to the lengthwise direction was a circular shape and having the external diameter shown in Table 2 was produced.

TABLE 2

| | | External | Hot Working Process | | Quenching Process Quenching | Tempering | [Mo | [Total Mo amount in precipitate at R/2 | [Total Mo amount in precipitate at center |
|---|---|---|---|---|---|---|---|---|---|
| Remarks | Test Number | Diameter (mm) | Hot Working Type | Forging Ratio | Temperature (° C.) | Process LMP | amount] (mass %) | position] (mass %) | position] (mass %) |
| Invention | 1 | 235.0 | Free Forging | 6.3 S | 920 | 17935 | 1.99 | 0.13 | 0.13 |
| Examples | 2 | 168.0 | Rotary Forging | 8.6 S | 920 | 17760 | 1.93 | 0.12 | 0.13 |
| | 3 | 225.0 | Hot Rolling | 6.9 S | 920 | 17760 | 1.95 | 0.13 | 0.13 |
| | 4 | 177.0 | Free Forging | 6.3 S | 920 | 17828 | 2.47 | 0.22 | 0.23 |

TABLE 2-continued

| | | | | | | | | | |
|---|---|---|---|---|---|---|---|---|---|
| | 5 | 235.0 | Free Forging | 6.3 S | 920 | 17932 | 2.49 | 0.24 | 0.24 |
| | 6 | 235.0 | Free Forging | 6.3 S | 950 | 17932 | 2.99 | 0.33 | 0.36 |
| | 7 | 235.0 | Free Forging | 6.3 S | 920 | 17760 | 2.11 | 0.14 | 0.16 |
| | 8 | 235.0 | Free Forging | 6.3 S | 920 | 17760 | 2.01 | 0.14 | 0.16 |
| | 9 | 235.0 | Free Forging | 6.3 S | 920 | 17760 | 2.00 | 0.13 | 0.13 |
| | 10 | 235.0 | Free Forging | 6.3 S | 920 | 17760 | 1.96 | 0.12 | 0.13 |
| | 11 | 235.0 | Free Forging | 6.3 S | 920 | 17760 | 2.02 | 0.14 | 0.16 |
| | 12 | 235.0 | Free Forging | 4.3 S | 920 | 17932 | 2.00 | 0.14 | 0.15 |
| Comparative | 13 | 152.4 | Free Forging | 15.0 S | 920 | 18139 | 1.93 | 0.22 | 0.25 |
| Examples | 14 | 196.9 | Free Forging | 9.0 S | 930 | 17981 | 1.65 | 0.19 | 0.21 |
| (Bar) | 15 | 225.0 | Free Forging | 6.9 S | 920 | 18086 | 1.99 | 0.19 | 0.21 |
| | 16 | 225.0 | Free Forging | 6.9 S | 920 | 18018 | 2.47 | 0.34 | 0.36 |
| | 17 | 225.0 | Free Forging | 6.9 S | 920 | 18191 | 2.47 | 0.47 | 0.51 |
| | 18 | 177.0 | Free Forging | 4.3 S | 920 | 18191 | 2.98 | 0.68 | 0.72 |
| | 19 | 235.0 | Free Forging | 6.3 S | 920 | 17760 | 2.01 | 0.15 | 0.19 |
| | 20 | 235.0 | Free Forging | 6.3 S | 920 | 17760 | 2.00 | 0.18 | 0.21 |
| | 21 | 235.0 | Rotary Forging | 4.3 S | 920 | 17932 | 1.99 | 0.13 | 0.18 |
| | 22 | 235.0 | Hot Rolling | 4.3 S | 920 | 17932 | 1.93 | 0.13 | 0.18 |
| Reference | 23 | 254.0 | — | — | 950 | 16409 | 2.99 | 0.10 | — |
| Examples | 24 | 254.0 | — | — | 950 | 16117 | 3.07 | 0.12 | — |
| (Steel Pipe) | 25 | 254.0 | — | — | 950 | 16902 | 3.00 | 0.18 | — |
| | 26 | 273.1 | — | — | 920 | 17820 | 3.00 | 0.36 | — |

| Remarks | Test Number | F1 | F2 | YS (MPa) | TS (MPa) | YS (ksi) | TS (ksi) | SSC resistance evaluation test (R/2 position) | SCC resistance evaluation test (R/2 position) | SSC resistance evaluation test (center position) | SCC resistance evaluation test (center position) |
|---|---|---|---|---|---|---|---|---|---|---|---|
| Invention | 1 | 1.47 | 0.00 | 827 | 883 | 120 | 128 | No SSC | No SCC | No SSC | No SCC |
| Examples | 2 | 1.45 | 0.01 | 772 | 834 | 112 | 121 | No SSC | No SCC | No SSC | No SCC |
| | 3 | 1.43 | 0.00 | 800 | 862 | 116 | 125 | No SSC | No SCC | No SSC | No SCC |
| | 4 | 1.59 | 0.01 | 848 | 910 | 123 | 132 | No SSC | No SCC | No SSC | No SCC |
| | 5 | 1.53 | 0.00 | 876 | 924 | 127 | 134 | No SSC | No SCC | No SSC | No SCC |
| | 6 | 1.67 | 0.03 | 917 | 972 | 133 | 141 | No SSC | No SCC | No SSC | No SCC |
| | 7 | 1.55 | 0.02 | 855 | 917 | 124 | 133 | No SSC | No SCC | No SSC | No SCC |
| | 8 | 1.45 | 0.02 | 848 | 910 | 123 | 132 | No SSC | No SCC | No SSC | No SCC |
| | 9 | 1.48 | 0.00 | 834 | 889 | 121 | 129 | No SSC | No SCC | No SSC | No SCC |
| | 10 | 1.48 | 0.01 | 820 | 883 | 119 | 128 | No SSC | No SCC | No SSC | No SCC |
| | 11 | 1.46 | 0.02 | 834 | 896 | 121 | 130 | No SSC | No SCC | No SSC | No SCC |
| | 12 | 1.44 | 0.01 | 841 | 904 | 122 | 131 | No SSC | No SCC | No SSC | No SCC |
| Comparative | 13 | 1.05 | 0.03 | 834 | 931 | 121 | 135 | SSC | SCC | SSC | SCC |
| Examples | 14 | 0.89 | 0.02 | 820 | 931 | 119 | 135 | SSC | SCC | SSC | SCC |
| (Bar) | 15 | 1.23 | 0.02 | 779 | 834 | 113 | 121 | SSC | No SCC | SSC | SCC |
| | 16 | 1.11 | 0.02 | 793 | 841 | 115 | 122 | SSC | SCC | SSC | SCC |
| | 17 | 0.59 | 0.04 | 834 | 889 | 121 | 129 | SSC | SCC | SSC | SCC |
| | 18 | 0.26 | 0.04 | 862 | 917 | 125 | 133 | SSC | No SCC | SSC | SCC |
| | 19 | 1.41 | 0.04 | 951 | 1018 | 138 | 148 | No SCC | No SCC | SSC | SCC |
| | 20 | 1.28 | 0.03 | 855 | 914 | 124 | 133 | SSC | SCC | SSC | SCC |
| | 21 | 1.47 | 0.05 | 848 | 896 | 123 | 130 | No SSC | No SCC | SSC | SCC |
| | 22 | 1.43 | 0.06 | 841 | 903 | 122 | 131 | No SSC | No SCC | SSC | SCC |
| Reference | 23 | 2.59 | — | 958 | 993 | 139 | 144 | No SSC | No SCC | — | — |
| Examples | 24 | 2.59 | — | 972 | 993 | 141 | 144 | No SSC | No SCC | — | — |
| (Steel Pipe) | 25 | 2.28 | — | 910 | 993 | 132 | 144 | No SSC | No SCC | — | — |
| | 26 | 1.56 | — | 889 | 993 | 129 | 144 | No SSC | No SCC | — | — |

In test numbers 23 to 26, a cast piece was produced by a continuous casting process using the aforementioned molten steel. The cast piece was subjected to billeting to form a billet, and thereafter piercing-rolling was performed according to the Mannesmann process to produce an intermediate material (seamless steel pipe) having the external diameter shown in Table 2 and having a through-hole in a center section. The wall thickness in test numbers 23, 24 and 26 was 17.78 mm, and the wall thickness in test number 25 was 26.24 mm.

The respective intermediate materials (steel bar or seamless steel pipe) that were produced were held for 0.5 hours at the quenching temperature (° C.) shown in Table 2, and thereafter were quenched (rapidly cooled). For each of the test numbers, the quenching temperature was equal to or higher than the $Ac_3$ transformation point. Thereafter, the respective intermediate materials were subjected to tempering at a tempering temperature in a range of 550 to 650° C. for a holding time of 4 to 12 hours, so that the Larson-Miller parameter LMP became the value shown in Table 2. Thus, steel materials (steel bar materials for a downhole member, and seamless steel pipes as reference examples) were produced.

The following evaluation tests were performed on the obtained steel materials.

[Measurement of Chemical Composition and [Mo Amount] of Each Steel Material]

The steel material of each test number was subjected to component analysis by the following method, and analysis of the chemical composition including the [Mo amount] was performed. The steel material of each test number was cut perpendicularly to the lengthwise direction thereof, and a sample with a length of 20 mm was extracted. The sample was made into machined chips, which were then dissolved in acid to obtain a liquid solution. The liquid solution was subjected to ICP-OES (Inductively Coupled Plasma Optical Emission Spectrometry), and elementary analysis of the chemical composition was performed. With respect to the C content and S content, the C content and S content were determined by combusting the aforementioned liquid solution in an oxygen gas flow by high-frequency heating, and detecting the generated carbon dioxide and sulfur dioxide.

[Measurement Test of [Total Mo Amount in Precipitate at R/2 Position] and [Total Mo Amount in Precipitate at Center Position]]

A sample (diameter of 9 mm and length of 70 mm) including a position (referred to as "R/2 position") that bisects a radius from the surface to the center of the steel bar for a downhole member was extracted at an arbitrary cross-section perpendicular to the lengthwise direction of the steel bar for a downhole member of each of test numbers 1 to 22. The lengthwise direction of the sample was parallel to the lengthwise direction of the steel bar for a downhole member, and the center of a transverse section (circle with a diameter of 9 mm) of the sample was the R/2 position of the steel bar for a downhole member. The specimen was electrolyzed using a 10% AA-based electrolytic solution (10% acetylacetone-1% tetramethylammonium chloride-methanol electrolytic solution). The current during electrolysis was set to 20 $mA/cm^2$. The electrolytic solution was filtrated using a 200-nm filter, and the mass of the residue was measured to determine the [total mass of precipitate at R/2 position]. In addition, the Mo amount contained in a solution in which the residue was subjected to acid decomposition was determined by ICP emission spectrometry. Based on the Mo amount and [total mass of precipitate at R/2 position] in the solution, the total Mo content (mass %) in the precipitate when the total mass of the precipitate at the R/2 position was taken as 100 (mass %) was determined. Five samples were extracted at arbitrary places, and the average value of the total Mo content in the precipitate determined from the respective samples was defined as the [total Mo amount in precipitate at R/2 position] (mass %).

Similarly, a sample (diameter of 9 mm, length of 70 mm) including the center position of the steel bar for a downhole member was extracted at an arbitrary cross-section perpendicular to the lengthwise direction of the steel bar for a downhole member of each of test numbers 1 to 22. The center of a transverse section (circle with a diameter of 9 mm) of the sample matched the central axis of the steel bar for a downhole member. Five samples were extracted at arbitrary places. Using a similar method as that adopted for determining the [total Mo amount in precipitate at R/2 position], the Mo amount in the solution and the [total mass of precipitate at center position] were determined, and the total Mo content (mass %) in the precipitate when the total mass of the precipitate at the center position was taken as 100 (mass %) was determined. The average value of the total Mo content in the precipitate determined for each sample (5 in total) was defined as the [total Mo amount in precipitate at center position] (mass %).

Note that, as reference material, for the seamless steel pipes of test numbers 23 to 26, a [total Mo amount in precipitate at wall thickness/2 position] was determined by the following method. At an arbitrary cross-section perpendicular to the lengthwise direction of the seamless steel pipe of each of test numbers 23 to 26, a sample (diameter of 9 mm, length of 70 mm) was extracted that included a position (wall thickness/2 position) at a depth of half the wall thickness (wall thickness/2) in the radial direction from the outer peripheral surface of the seamless steel pipe. The lengthwise direction of the sample was parallel to the lengthwise direction of the seamless steel pipe, and the center of a transverse section (circle with a diameter of 9 mm) of the sample was the wall thickness/2 position of the seamless steel pipe. The specimen was electrolyzed using a 10% AA-based electrolytic solution (10% acetylacetone-1% tetramethylammonium chloride-methanol electrolytic solution). The current during electrolysis was set to 20 $mA/cm^2$. The electrolytic solution was filtrated using a 200-nm filter, and the mass of the residue was measured to determine the [total mass of precipitate at wall thickness/2 position]. In addition, the Mo amount contained in a solution in which the residue was subjected to acid decomposition was determined by ICP emission spectrometry. Based on the Mo amount in the solution and the [total mass of precipitate at wall thickness/2 position], the total Mo content (mass %) in the precipitate when the total mass of the precipitate at the wall thickness/2 position was taken as 100 (mass %) was determined. Five samples were extracted at arbitrary places, and the average value of the total Mo content in the precipitate determined from the respective samples was defined as the [total Mo amount in precipitate at wall thickness/2 position] (mass %).

The values for [total Mo amount in precipitate at wall thickness/2 position] of test numbers 23 to 26 are described in the column for [total Mo amount in precipitate at R/2 position] in Table 2. Note that, for test numbers 23 to 26, F1 was determined by the following formula.

$F1$ of test numbers 23 to 26=[Mo amount]−4×[total Mo amount in precipitate at wall thickness/2 position]

[Tension Test]

A tensile test specimen was taken from the R/2 position of the steel bar for a downhole member of each of test numbers 1 to 22. The lengthwise direction of the tensile test specimens of test numbers 1 to 22 was parallel to the lengthwise direction of the respective steel bars for a downhole member, and the central axis matched the R/2 position of the steel bar for a downhole member. Further, a tensile test specimen was taken from the center position of the wall thickness of the seamless steel pipe of each of test numbers 23 to 26. The lengthwise direction of the tensile test specimens of test numbers 23 to 26 was parallel to the lengthwise direction of the respective seamless steel pipes, and the central axis matched the wall thickness/2 position of the seamless steel pipe. The length of a parallel portion of the respective tensile test specimens was 35.6 mm or 25.4 mm. A tension test was performed at normal temperature (25° C.) in atmosphere using the respective tensile test specimens, and the yield strength (MPa, ksi) and tensile strength (MPa, ksi) were determined.

[SSC Resistance Evaluation Test]

A round bar specimen was extracted from the R/2 position and center position of the steel bar for a downhole member of each of test numbers 1 to 22, and from the wall thickness/2 position (wall thickness center position) of the seamless steel pipe of each of test numbers 23 to 26. The lengthwise direction of the round bar specimen extracted from the R/2 position of the respective steel bars for a downhole member of test numbers 1 to 22 was parallel with the lengthwise direction of the steel bar for a downhole member, and the central axis matched the R/2 position. The lengthwise direction of the round bar specimen extracted from the center position of the respective steel bars for a downhole member of test numbers 1 to 22 was parallel with the lengthwise direction of the steel bar for a downhole member, and the central axis matched the center position of the steel bar for a downhole member. The lengthwise direction of the round bar specimen extracted from the wall thickness/2 position of the respective seamless steel pipes of test numbers 23 to 26 was parallel with the lengthwise direction of the seamless steel pipe, and the central axis matched the wall thickness/2 position. The external diameter of a parallel portion of each round bar specimen was 6.35 mm, and the length of the parallel portion was 25.4 mm.

The SSC resistance of each round bar specimen was evaluated by a constant load test in conformity with the NACE TM0177 Method A. A 20% sodium chloride aqueous solution held at 24° C. with a pH of 4.5 in which $H_2S$ gas of 0.05 bar and $CO_2$ gas of 0.95 bar were saturated was used as the test bath. A load stress corresponding to 90% of the actual yield stress (AYS) of the steel material of the corresponding test number was applied to the respective round bar specimens, and the round bar specimens were immersed for 720 hours in the test bath. After 720 hours elapsed, whether or not the respective round bar specimens had ruptured was confirmed by means of an optical microscope with ×100 field. If the round bar specimen had not ruptured, the SSC resistance of the steel was judged to be high (shown as "No SSC" in Table 2). If the round bar specimen had ruptured, the SSC resistance of the steel was judged to be low (shown as "SSC" in Table 2).

[SCC Resistance Evaluation Test]

A rectangular test specimen was extracted from the R/2 position and center position of the steel bar for a downhole member of each of test numbers 1 to 22, and from the wall thickness/2 position (wall thickness center position) of the seamless steel pipe of each of test numbers 23 to 26. The lengthwise direction of the rectangular test specimen extracted from the R/2 position of the respective steel bars for a downhole member of test numbers 1 to 22 was parallel with the lengthwise direction of the steel bar for a downhole member, and the central axis matched the R/2 position. The lengthwise direction of the rectangular test specimen extracted from the center position of the respective steel bars for a downhole member of test numbers 1 to 22 was parallel with the lengthwise direction of the steel bar for a downhole member, and the central axis matched the center position of the steel bar for a downhole member. The lengthwise direction of the rectangular test specimen extracted from the wall thickness/2 position of the respective seamless steel pipes of test numbers 23 to 26 was parallel with the lengthwise direction of the seamless steel pipe, and the central axis matched the wall thickness/2 position. The thickness of each rectangular test specimen was 2 mm, the width was 10 mm, and the length was 75 mm.

A stress corresponding to 100% of the actual yield stress (AYS) of the steel material of the respective test numbers was applied to each test specimen by four-point bending in conformity with ASTM G39.

Autoclaves maintained at 150° C. in which $H_2S$ of 0.05 bar and $CO_2$ of 60 bar were charged under pressurization were prepared. The respective test specimens to which stress was applied as described above were stored in respective autoclaves. In each autoclave, each test specimen was immersed for 720 hours in a 20% sodium chloride aqueous solution with a pH of 4.5.

After being immersed for 720 hours, whether or not stress corrosion cracking (SCC) had occurred was checked for each of the test specimens. Specifically, a cross-section of a portion to which tensile stress was applied of each test specimen was observed with an optical microscope with ×100 field, and the presence or absence of cracks was determined. If SCC was confirmed, it was determined that the SCC resistance was low (shown as "SCC" in Table 2). If SCC was not confirmed, it was determined that the SCC resistance was high (shown as "No SCC" in Table 2).

[Test Results]

Referring to Table 2, the chemical compositions of the steel materials for a downhole member of test numbers 1 to 12 were appropriate, and in particular the Cu content was in the range of 0.10 to 2.50. In addition, F1 satisfied Formula (1), and F2 satisfied Formula (2). As a result, the yield strength YS was 758 MPa (110 ksi) or more, and a high strength was obtained. In addition, even though each of the steel materials had a high strength, each steel material was excellent in SCC resistance and SSC resistance, and SCC and SSC did not occur at either the R/2 position or the center position.

On the other hand, in test number 13, the C content and V content were too high, and the Cu content and Ti content were too low. Furthermore, the Larson-Miller parameter LMP in the tempering process was too high. Consequently, F1 was less than 1.30 and did not satisfy Formula (1). As a result, SCC and SSC were confirmed at both of the R/2 position and the center position, and the SSC resistance and SCC resistance were low.

In test number 14, the Cu content and Ti content were too low. Consequently, F1 was less than 1.30 and did not satisfy Formula (1). As a result, SCC and SSC were confirmed at both of the R/2 position and the center position, and the SSC resistance and SCC resistance were low.

In test numbers 15 to 18, although the respective chemical compositions were appropriate, the Larson-Miller parameter LMP was too high in the tempering process. Consequently, F1 was less than 1.30 and did not satisfy Formula (1). As a result, SCC and/or SSC was confirmed at both of the R/2 position and the center position, and the SSC resistance and SCC resistance were low.

In test number 19, the Cu content was too high. Therefore, even though the forging ratio during hot working was appropriate, F2 did not satisfy Formula (2). As a result, SCC and SSC were confirmed at the center position, and the SSC resistance and SCC resistance were low.

In test number 20, the Cu content was too low. Therefore, even though the forging ratio during hot working was appropriate and the Larson-Miller parameter LMP in the tempering process was appropriate, F1 did not satisfy Formula (1). As a result, SCC and SSC were confirmed at both of the R/2 position and the center position, and the SSC resistance and SCC resistance were low.

In test numbers 21 and 22, although the chemical composition was appropriate, the forging ratio during hot working was too low. Therefore, F2 did not satisfy Formula (2). As a result, SCC and SSC were confirmed at the center position, and the SSC resistance and SCC resistance were low.

Note that, in test numbers 23 to 26, although the Cu content was low, the steel material was a seamless steel pipe. Therefore, F1 (=[Mo amount]−4×[total Mo amount in precipitate at wall thickness/2 position]) was 1.30 or more, and the SSC resistance and SCC resistance were good.

An embodiment of the present invention has been described above. However, the above described embodiment is merely an example for implementing the present invention. Accordingly, the present invention is not limited to the above described embodiment, and the above described embodiment can be appropriately modified within a range which does not deviate from the scope of the present invention.

The invention claimed is:

1. A steel bar for a downhole member, the steel bar having a diameter of 152.4 to 215.9 mm and having a chemical composition consisting of, by mass %:

C: 0.020 or less,
Si: 1.0 or less,
Mn: 1.0 or less,
P: 0.03 or less,
S: 0.01 or less,
Cu: 0.10 to 2.50,
Cr: 10 to 14,
Ni: 1.5 to 7.0,
Mo: 0.2 to 3.0,
Ti: 0.05 to 0.3,
V: 0.01 to 0.10,
Nb: 0.1 or less,
Al: 0.001 to 0.1,
N: 0.05 or less,
B: 0 to 0.005,
Ca: 0 to 0.008, and
Co: 0 to 0.5,
with the balance being Fe and impurities,
wherein:

when an Mo content in the chemical composition of the steel bar for a downhole member is defined as [Mo amount] (mass %), and an Mo content in precipitate at a position that bisects a line connecting a surface of the steel bar for a downhole member to a center of a cross-section perpendicular to a lengthwise direction of the steel bar for a downhole member is defined as [total Mo amount in precipitate at R/2 position] (mass %), the steel bar for a downhole member satisfies Formula (1), and when an Mo content in precipitate at a center position in a cross-section perpendicular to the lengthwise direction of the steel bar for a downhole member is defined as [total Mo amount in precipitate at center position], the steel bar for a downhole member satisfies Formula (2);

$$[\text{Mo amount}]-4\times[\text{total Mo amount in precipitate at R/2 position}]\leq 1.30 \quad (1)$$

$$[\text{Total Mo amount in precipitate at center position}]-[\text{total Mo amount in precipitate at R/2 position}]\leq 0.03 \quad (2).$$

2. The steel bar for a downhole member according to claim 1, wherein the chemical composition contains, in lieu of a part of Fe, one or more elements selected from a group consisting of:

B: 0.0001 to 0.005 mass %, and
Ca: 0.0005 to 0.008 mass %.

3. The steel bar for a downhole member according to claim 1, wherein the chemical composition contains, in lieu of a part of Fe:

Co: 0.05 to 0.5 mass %.

4. The steel bar for a downhole member according to claim 2, wherein the chemical composition contains, in lieu of a part of Fe:

Co: 0.05 to 0.5 mass %.

* * * * *